US005467625A

United States Patent [19]

Holthoff

[11] Patent Number: 5,467,625

[45] **Date of Patent: * Nov. 21, 1995**

[54] ARRANGEMENT FOR ADJUSTING OF THREE ROLLERS OR GUIDING ROLLS WHICH TOGETHER FORM A CALIBER OPENING

[75] Inventor: Helmut Holthoff, Duesseldorf, Germany

[73] Assignee: Kocks Technik GmbH & Co., Hilden, Germany

[ * ] Notice: The portion of the term of this patent subsequent to Oct. 18, 2011, has been disclaimed.

[21] Appl. No.: 236,367

[22] Filed: Apr. 29, 1994

Related U.S. Application Data

[63] Continuation of Ser. No. 970,085, Nov. 3, 1992, Pat. No. 5,355,704.

[30] Foreign Application Priority Data

Nov. 14, 1991 [DE] Germany ..... 41 37 451.7

[51] Int. Cl.[6] ..... B21B 31/16; B23Q 17/22

[52] U.S. Cl. ..... 72/35; 72/37; 72/239

[58] Field of Search ..... 72/21, 35, 37, 72/239; 116/231; 356/391

[56] References Cited

U.S. PATENT DOCUMENTS

| | | | |
|---|---|---|---|
| 2,485,355 | 10/1949 | Brennan | 356/397 |
| 3,544,223 | 12/1970 | Bartlett | 356/392 |
| 3,834,820 | 9/1974 | Bock | 356/391 |
| 4,329,785 | 5/1982 | Peterson | 356/154 |
| 4,548,503 | 10/1985 | Liesch et al. | 72/35 |
| 5,355,704 | 10/1994 | Holthoff | 72/35 |

FOREIGN PATENT DOCUMENTS

| | | | |
|---|---|---|---|
| 0097260 | 1/1984 | European Pat. Off. | 72/224 |
| 1056194 | 1/1967 | United Kingdom | 356/153 |

*Primary Examiner*—Lowell A. Larson
*Assistant Examiner*—Thomas C. Schoeffler
*Attorney, Agent, or Firm*—Michael J. Striker

[57] ABSTRACT

For adjusting of three caliber opening rollers or guiding rolls, a light source is arranged on the one side of the roller or guiding roll, a device is located at another side of the roller or the guiding roll and receives a shadow image of a caliber contour and has a turnable, displaceable and arrestable bar template. The bar template has at least one polygon which corresponds to the number of rollers or guiding rolls of a caliber and sides which are offset from one another with the same angular position as rotary axes of the rollers or guiding rolls, and center points of inscribed circles of several such polygons are located on one another.

1 Claim, 9 Drawing Sheets

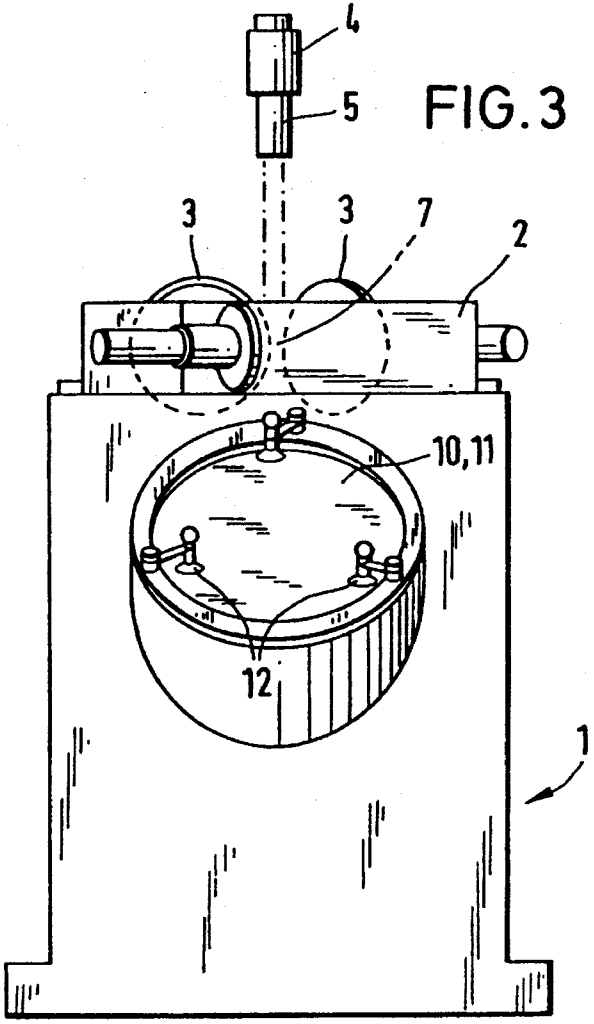
FIG. 3
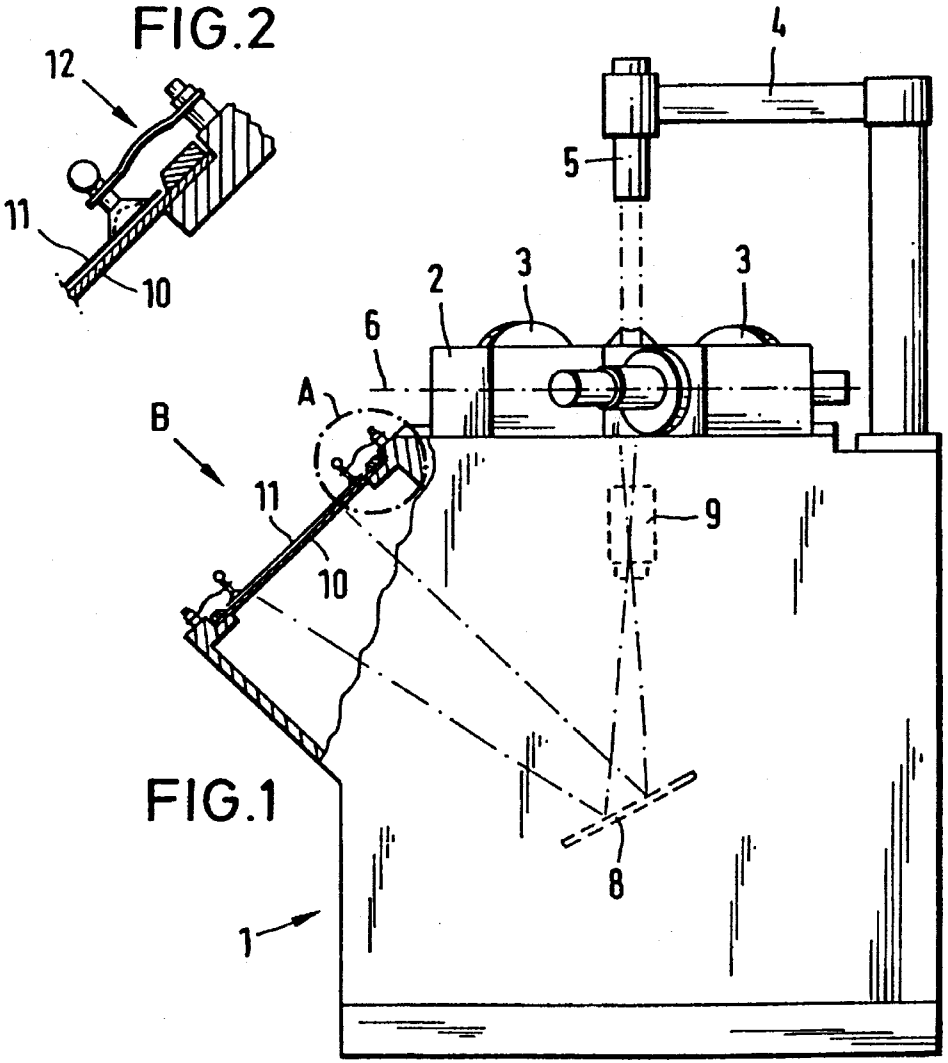
FIG. 1
FIG. 2

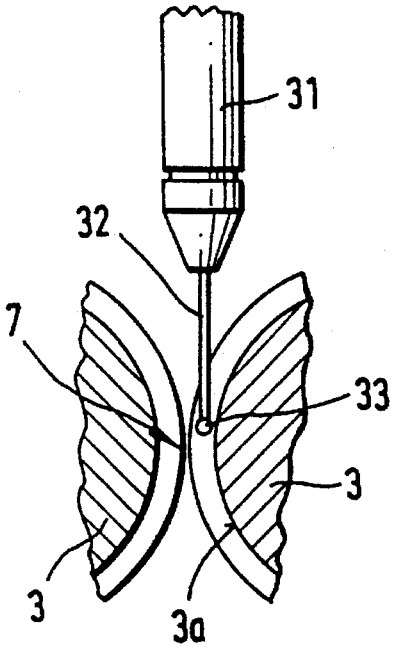
FIG.15
FIG.14
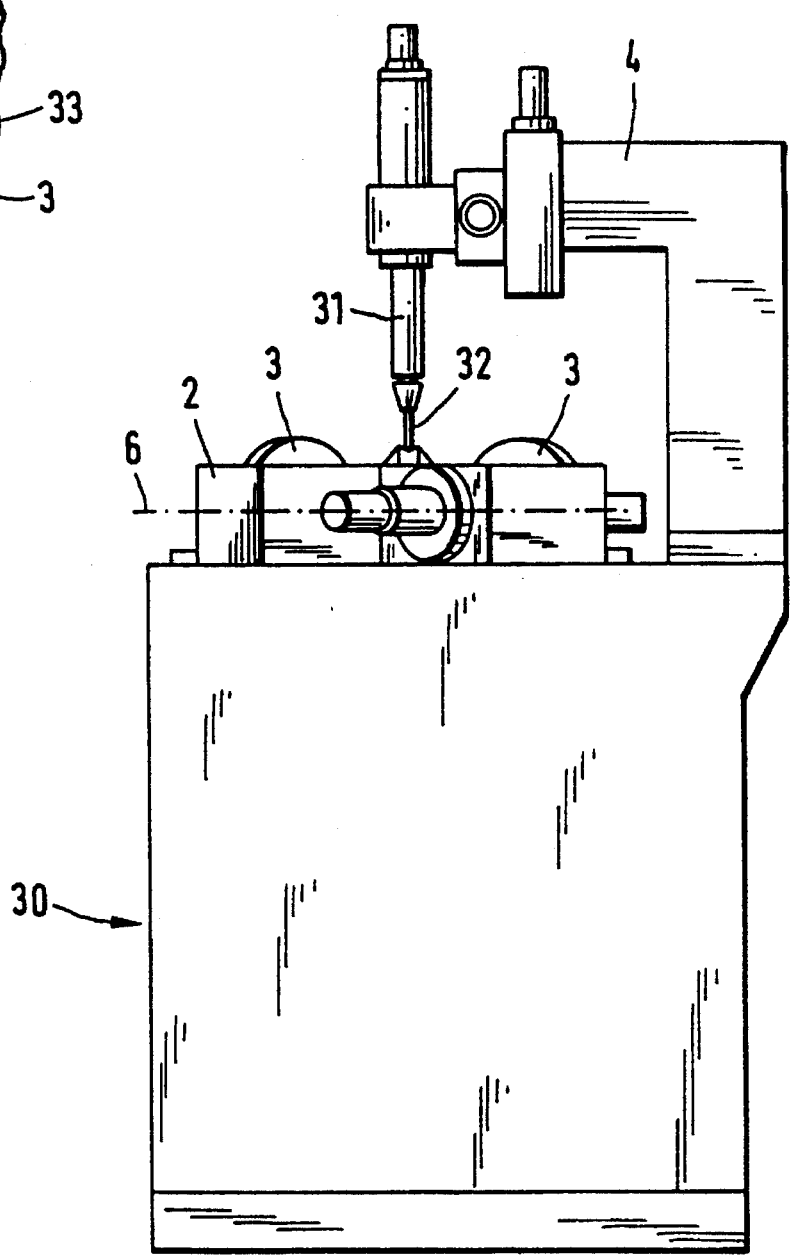

ARRANGEMENT FOR ADJUSTING OF THREE ROLLERS OR GUIDING ROLLS WHICH TOGETHER FORM A CALIBER OPENING

This is a continuation of application Ser. No. 970,085, filed Nov. 3, 1992, now U.S. Pat. No. 5,355,704.

BACKGROUND OF THE INVENTION

The present invention relates to a method of and an arrangement for adjusting of three rollers or guiding rollers which together form a caliber opening.

In rolling stands for rolling wires, bars and pipes the caliber openings which are formed by rolling elements such as rollers or guiding rolls must be made with the accurate size and shape to provide the required narrow size tolerances and the desired high shape accuracy of the rolled products. This first of all is true for the last caliber opening or openings of a rolling path. For obtaining this accuracy also for a caliber opening which is formed by three rollers or guiding rolls, the working surfaces of the rollers or the guiding rolls which come into contact with the rolled product are machined in condition ready for operation when they are built in the rolling stand or guiding housing. This process, however, is very expensive. Moreover, the desired accuracy is not always achieved. This is especially true when it is not possible to provide chip-removing working inside the caliber opening. In contrast, the outer contours of the rollers or guiding rolls can be produced in quieter and more accurate fashion individually in disassembled condition on precision-operating machine tools. In this case rollers with accurate profiles can be obtained, formed from the working and edge surfaces as well as the transition radii. However, also no accurate caliber opening is guaranteed. In order to provide this, it is additionally necessary to exactly adjust the rollers or the guiding rolls relative to one another, since with the abutment surfaces, fixed supports and similar elements it cannot be guaranteed that each roller or guiding roll after its production in disassembled condition and subsequent assembly assumes the exactly predetermined position. Each roller or guiding roll after its assembly, must be adjusted in an axial direction, or in other words in the direction of the rotary axis of the rollers, must be also adjusted in a radial direction. The bearing permits such an adjustment.

The invention deals with a method of adjusting of three rollers or guiding rolls which together form a caliber opening, which are offset in a star-like fashion around a throughgoing axis which forms a center of a caliber opening, and which have concavely shaped working surfaces. The method can also be used for adjusting of five or more rollers or guiding rolls which form a caliber opening which hardly happens in practice.

In accordance with the known method of this type, a light source is arranged at one side of the caliber opening, while at the other end a device is arranged which receives the shadow image around the caliber opening and can recognize its contours. Such device can be formed, for example, as a ground glass. As a rule, an amplifying optical system is arranged between them to obtain a clear shadow image. On it, the limits of the caliber opening are recognized by the working surfaces, for example, of the rollers as well as small roller gaps which remain between the facing inclined edge surfaces of the neighboring rollers. Also the transition radii between the working surfaces and edge surfaces are recognizable. A bar template is applied on the ground glass which indicates the shadow image. For adjusting the rollers of a three roller caliber it is marked with three ray lines which extend in radial direction from one another from one point in a star-like fashion and offset relative to one another by 120° in correspondence with the conventional 120° arrangement of the rollers of the three roller caliber. The bar template is applied in the known method on the ground glass so that each of the three ray lines comes to abutment in the center of one of the three roller gaps of the shadow image. The intersecting point of the ray lines marks then the center of the caliber opening. Starting from this caliber center, the contours of the caliber opening can then be worked or controlled and the rollers of the guiding rolls can be adjusted in the radial direction.

This known method is, however, inaccurate and can be implemented only with difficulties when the roller gaps shown on the shadow image have different widths as frequently occurs. The reason for this can be that the rollers have different diameters. Moreover, the rollers are often arranged displaceably in an axial direction. Furthermore, the inclined edge surfaces of the rollers formed between the roller gaps at the concave working surfaces can have an offset, since the edge surfaces are not always worked together with the working surfaces. In these frequently occurring cases it is extraordinarily difficult, if not impossible, to exactly orient the bar template with the above described methods, in order to determine in this manner the position of the caliber center. If it is not or cannot be sufficiently accurately determined, an accurate adjustment of the rollers or guiding rolls of the caliber is not possible.

The caliber center is a geometrical center of the caliber opening formed by the working surfaces of three rollers or guiding rolls. It does not necessarily coincide with the rolling stand center or with the center of the inscribed circle of each triangle which forms the rotary axes of the rollers. Therefore, when for example, the diameters of the three rollers or guiding rolls which form a caliber are not uniform due to different wear or manufacturing inaccuracies, the caliber center is located in a point different from the center of the rolling stand. Thus, for determination of the caliber center one cannot go from the center of the rolling stand or the center of the guiding rolls housing and also not from the measuring surfaces, since during the mounting and dismounting of the rollers always certain displacements occur. For the same reason the rotary axes of the rollers or guiding rolls are not suitable as orienting lines for the adjustment. Also, one cannot go from the edge surfaces of the rollers of the guiding rolls due to the possibility of an offset between them and the working surface contours. Therefore, with the extremely high manufacturing accuracy of the rollers, the guiding rollers, the bearings, the stand and the guiding housing, the desired high accuracy could not be achieved even with extremely high costs.

SUMMARY OF THE INVENTION

Accordingly, it is an object of the present invention to provide a method of adjustment of three rolling elements which form a joint caliber opening, with which the rolling elements especially a three roller caliber, can be adjustable in axial and radial direction faster and more accurate than before, and as a result an individual working of the rolling elements can be performed in disassembled condition.

In keeping with these objects and with others which will become apparent hereinafter, one feature of the present invention resides, briefly stated, in a method which includes adjusting of three caliber opening forming rolling elements arranged in a star-pattern around a throughgoing axis which forms a caliber center and having concave working surfaces, comprising the steps of determining for each rolling elements a triangle which is formed by three parallels each extending in a joint rotary axis plane through a deepest point in a caliber bottom and also determining a center point of an inscribed circle of the triangle, and axially displacing the rolling elements so that a section plane extending through the deepest point and perpendicularly to the rotary axis is adjusted so that the section plane extends through the center point of the inscribed circle.

Therefore, a method is proposed in accordance with which for adjusting the rollers or the guiding rolls one can go exclusively from the contours of the working surfaces of the rollers or guiding rolls which alone form the caliber opening. As a result, the highest accuracy is possible in that, all frequently inaccurate auxiliary surfaces are avoided and unavoidable manufacturing tolerances in the region of the auxiliary surfaces, shafts, bearings and the like are eliminated. For each roller or guiding roll one goes from the caliber contour, determines from it the triangle associated with the three rollers and the center point of its inscribed circle Which is identical with the caliber center. The caliber center or the center point of the inscribed circle can be found in a manner known for the triangle with the aid of its angle bisectors which intersect at this point. When this point or in other words the caliber center is determined, then the rollers or the guiding rolls are adjusted fast and accurately by axial and radial displacement to this caliber center. As a result the rollers or the guiding rolls can be worked in advantageous manner outside the rolling stand in conventional accurately operating grinding or turning machines so that the special working machines are no longer required. The conventional high quality machine tools make possible not only the working of the working surfaces but also the working of the edge surfaces and transitions on the rollers and guiding rolls in one working step, so as to save time and roller material with high accuracy. Any offset between the working and edge surfaces is avoided, which moreover within predetermined limits, is not disturbing. The rollers and the guiding rolls can be worked without making available a stand or a guiding housing, so that the required number of the same is small. The rolling stand and the guiding housing are no longer dirtied during the chip removing working process. Without the accurate inventive adjusting method such advantages cannot be obtained.

It is especially advantageous when for determination of the position of the center point of the inscribed circle, a shadow image of all working surface contours of the rollers or guiding rolls is projected onto a bar template with at least one marked triangle formed from sides with the angle position of all rotary axes and with a center point of the joint inscribed circle of several triangles. Then the bar template is turned and displaced so that all sides of a shadow image of one of the triangles extends parallel to the rotary axes of the projected shadow image and through the deepest point in the associated caliber bottom or at a distance from it. The above mentioned angular position of the rotary axes of the rollers or guiding rolls is always known, since the bearing openings of the rollers extend or the guiding housings are produced under this angular position. With a caliber formed from three rollers, the rotary axes extend as a rule at 120° relative to one another so that the triangle on the bar template is a unilateral triangle. If as an exception another angular position is preferable, it is also known and a corresponding different triangle is marked on the bar template. The angular position of all rotary axes can be exactly maintained with the modern power tools during the manufacturing of the bearing openings, so that no significant inaccuracies are produced and the triangle marked on the bar template corresponds to the actual angular position of all rotary axes with high accuracy. Preferably, several triangles of different sizes or the same angular positions of all sizes must be marked on the bar template, and the inscribed circle center points must coincide with one another.

A bar template prepared in this manner must be oriented and arrested relative to the projected shadow image. In accordance with the present invention, for orienting all triangle sides of the bar template parallel to the rotary axes of the shadow image, at least one roller or guiding roll is axially offset and the bar template is brought by turning in such a position that during axial displacement of this roller or guiding roll an always identical sickle gap remains between the shadow image of its working surface and an associated triangle side of the bar template. After this the bar template is arrested in this position against turning.

In accordance with a further method step it is recommended that, for orienting all triangle sides of the bar template to the deepest points of the caliber bottom of the shadow image, the sides of one of the triangles are brought only by parallel displacement of the bar template with the deepest point of all working surfaces for coincidence, or adjusted in the same radial distance from the deepest point and the bar template is then arrested completely in this position. In this two-stage method for orienting of the triangle sides or the bar template relative to the shadow image, only the contours of the working surfaces are used. Therefore, the above explained problems of the known methods during orientation of the template are avoided and a high accuracy is simultaneously guaranteed. Since the triangle or triangles marked on the bar template have sides whose angular position relative to one another coincides with the known angular position of all rotary axes, the orientation of only one triangle side parallel to the associated rotary axis is sufficient and the other triangle sides are automatically oriented, also parallel to their associated rotary axes. The inscribed circle center point of this triangle or these triangles can be determined on the bar template, in that with the angle bisectors constructed so that their intersecting point is the center point of the inscribed circle. When several triangles of different sizes are marked, then they can be concentrically oriented, so that in other words their inscribed circle center points lie exactly on one another. If the bar template is oriented in the above described manner relative to the shadow image of the rollers or guiding rolls then the inscribed circle center point exactly indicates on the bar template the position of the caliber center.

In accordance with the inventive method, after the orientation of the bar template for axial adjustment of each roller or guiding roll, the respective deepest points of their caliber bottom are adjusted to the section plane extending through the inscribed circle center point and perpendicularly to the associated triangle side or rotary axis. This is, however, not simple and it is not possible with the desired accuracy to determine the deepest point of the caliber bottom and thereby the section plane of the rollers or guiding rolls with the respective shadow images without special measures. When the inscribed circle center point and the section plane are marked on the bar template which can be exactly constructed, it is of little use since the deepest point and the cutting plane of the shadow image are not recognizable with the required accuracy. As a result they cannot be brought in coincidence with the section plane marking on the bar template by displacing the rollers or guiding rods. An axial adjustment of each roller or guiding roll performed by evaluation remains positively inaccurate. In order to solve this problem it is proposed in accordance with the invention that, for axial adjustment of the deepest point of the rollers or the guiding rolls to the section planes, two identical sickle gaps between the shadow image of each working surface and symmetrical at both sides of the section plane are adjusted to the roof-shaped or circular arc-shaped orientation lines marked on the bar template, by axial displacement of the rollers or guiding rolls. The axial adjustment of the rollers or guiding rolls is performed by the adjustment of two identical sickle gaps.

During the orientation of the bar template, only the contours of the working surfaces of the rollers or guiding rolls are used and not other auxiliary surfaces. The orientation lines marked on the bar template can be exactly constructed then in a simple manner. For this purpose the inscribed circle center point on the bar template is required, which however, must not necessarily be recognizable on the finished bar template since it is not required for the adjustment of the rollers or guiding rolls.

During the last step of the inventive method it is recommended that, after the axial adjustment of the rollers or the guiding rolls, also, for radial adjustment the triangle sides or orientation lines marked on the bar template are utilized. Each roller or guiding roll can be adjusted individually. However, a joint radial adjustment is also possible when a corresponding adjustment for example in the rolling stand is provided. With the plurality of triangle sides and orientation lines marked on the bar template, it is possible after the axial adjustment of the rollers or guiding rolls, to provide an exact radial adjustment. Here also, exclusively the contours of the working surfaces are decisive, and adjusted to the same radial distance from a selected triangle or associated orientation line.

As can be shown from experience, the above described method with the optical adjustment provides a possibility for an adjustment accuracy in the order of a hundredth millimeter. The method, however, presupposes that the concave working surfaces of the rollers or guiding rolls have a symmetrical shape. Since, however, in practice this is exactly the case, an acceptable solution of the existing adjusting problem therefore is provided.

The inventive method is performed with the optical means as described hereinabove. However, it is possible to use other means. Alternatively, it is proposed for determination of the position of the inscribed circle center point, to sense the contours of the concave working surfaces of all rollers and guiding rolls in a common rotary axis plane with a measuring probe of a measuring device and to supply the measuring values to a computer with a computer program which determines the position of the deepest point of the parallels extending through each respective working surface relative to the rotary axes of a triangle which is formed from the parallels or rotary axes and its inscribed circle center point. Such measuring devices and computers are known; however, their use in the inventive method is not known. In conventional three roller stands with rollers which are offset relative to one another exactly by 120°, the 120° arrangement is considered by the computer program of the computer. Other recommended angular positions are also programmable, as long as the angular position of the rotary axes is known in all cases and is exactly maintained during the production of the rolling stand or guiding housing. It is however required to orient the measuring device exactly relative to the rotary axes in the beginning of the adjusting process. It is recommended, for orienting the measuring device relative to the angular position of the rotary axes, first to displace one roller or guiding roll and determine in both end positions the position of the deepest point and their connecting line and thereby to determine the angular position of this rotary axis as well as the remaining rotary axes. When the computer recognizes the angular position of one rotary axis, then the remaining rotary axes are known by the computer since its computing program includes the displacement angle between the rotary axes. Moreover, in addition to another angular position, also another number of rollers or guiding rolls by caliber is possible.

For axial adjustment of each roller or guiding roll, after the determination of the inscribed circle center point the axial position of the deepest point and its offset relative to the associated section plane through the inscribed circle center point and perpendicularly to the rotary axis is determined by a measuring device and its computer. The roller or the guiding roll is then axially displaced by its offset.

For radial adjustment of the rollers or the guiding rolls after the axial adjustment of the same the actual distances of all deepest points from inscribed angle or caliber center point is determined by the measuring device with its computer, the difference between the distances and the desired caliber radius is computed, and the rollers or guiding rolls are radially displaced by this difference. Here also the adjustment of the rollers or the guiding rolls can be performed individually or jointly, depending on the construction of the rolling stand or the guiding housing. After the adjustment, again a control can be performed by the measuring device and its computer.

The present invention also deals with an arrangement for performing the inventive method. In the arrangement a light source is provided at each side of the rollers or guiding rolls and a device for receiving the shadow image of the caliber contour is provided at the other side and has a rotatable, displaceable and arrestable bar template. This device is characterized in accordance with the present invention in that, the bar template has at least one polygon which corresponds to the rollers or guiding roll number of the caliber. The polygon has sides extending relative to one another in the same angular position as the rotary axes of the rollers or guiding rolls, and with several polygons of different sizes their inscribed circle center points coincide with one another.

It is advantageous when in addition to the polygon or polygons corresponding to the roller or guiding roll number, one or several additional polygons with double corner number are marked on the bar template. Each second corner of them lies on the same radial line with the corner of the first mentioned polygon, and their inscribed circle center point is located on the inscribed circle center points of the first mentioned polygons. Roof-shaped orientation lines are obtained, which make possible an exact axial adjustment of the rollers or guiding rolls. To the contrary, it is however also possible that in addition to the polygon or polygons corresponding to the rollers or guiding roll number, one or several concentric circular arcs are marked on the bar template. Their center point coincides with the section planes extending through the inscribed circle center point and perpendicularly to the polygon sides. It is advantageous when the circular arc radii are somewhat greater or smaller than the radii of the caliber opening. In this manner substantial sickle gaps are produced, which are required for the adjustment of the rollers or guiding rolls.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is an adjusting device in accordance with the present invention on a side view;

FIG. 2 is a view showing a detail A of FIG. 1;

FIG. 3 is an adjusting device of FIG. 1 on a front view;

FIG. 14 is a measuring device in accordance with the present invention in a side view;

FIG. 15 is a view showing a section through a caliber opening with a measuring probe;

DESCRIPTION OF THE PREFERRED EMBODIMENTS

Figure 4:
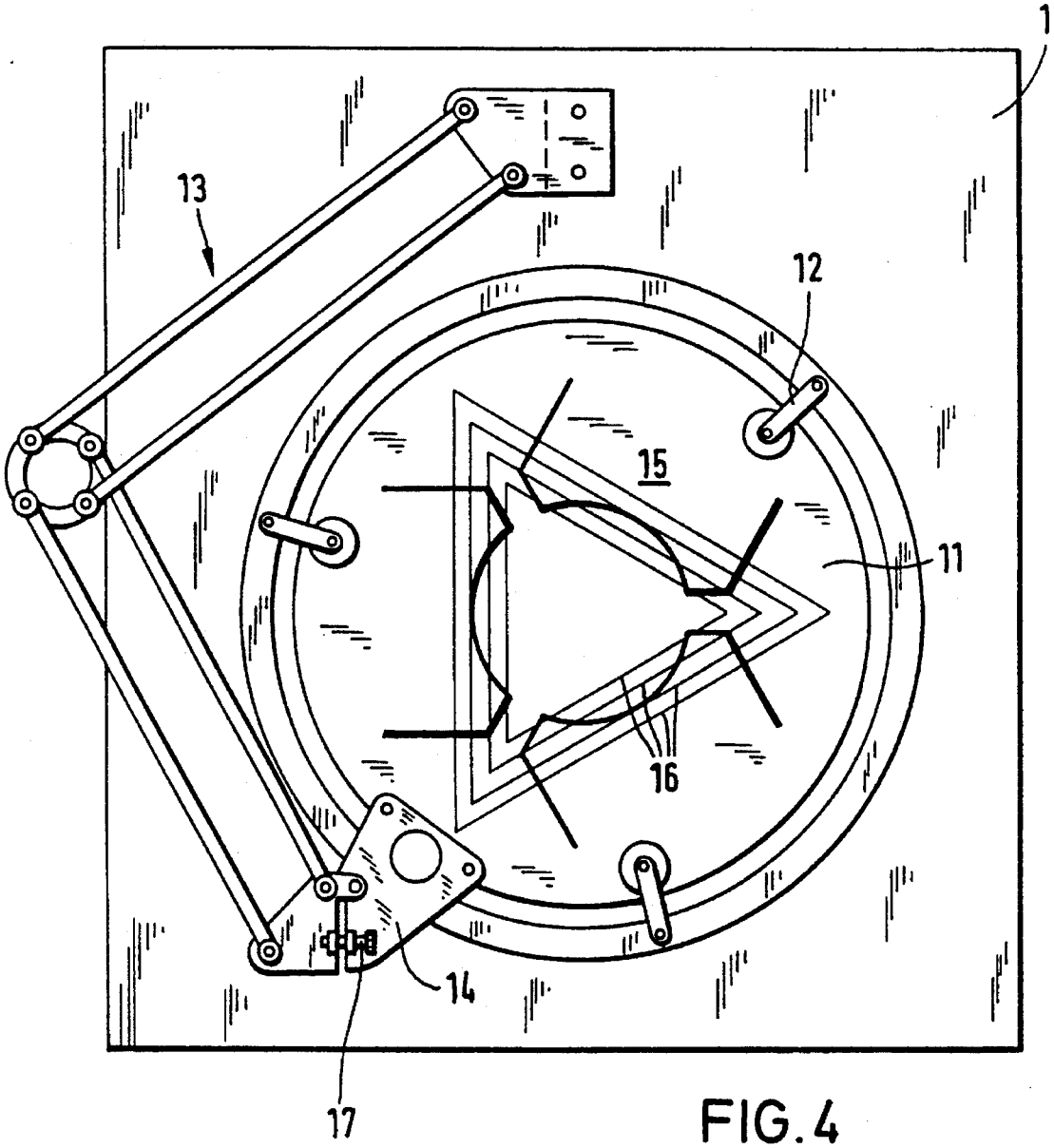
FIG. 4 is a view as seen in direction B in FIG. 1.

FIGS. 1–3 show an adjusting device 1 and a rolling stand 2 which is supported on the adjusting device in lying position. Three rollers 3 are mounted in the rolling stand 2 ready for operation. A holder 4 holds above the rolling stand 2 a light source 5. Light rays of light source 5 pass through a caliber opening 7 which is formed by rollers 3 and located in the plane of the rotary axis 6, and then falls on an inclined mirror 8. An optical system 9 marks a contour-sharp and amplified image for the caliber opening 7 reflected from the mirror 8 on a ground disc 10. A transparent bar template 11 is arranged on the ground disc. It can be displaced and turned relative to the ground disc 10 in any direction, and also is reliably arrestable by means of a holder 12.

FIG. 4 shows the region of the ground disc 10 on an increased scale, and a parallelogram guide 13 which for simplifying the illustration is not shown in FIGS. 1 and 3. The parallelogram guide 13 is known in indicating machines on drawing boards. However, instead of the rulers it has a template holder 14, in which the bar template 11 can be exchangeably clamped. Before the clamping with the holder 12 releases, the bar template 11 is coarsely oriented relative to a shadow image 15 of the drive rollers usually, so that triangle sides 16 marked on the bar template 11 extend substantially parallel to the rotary axes of the rollers 3. A fine adjustment of the bar template in the rotary direction is possible by means of an adjusting screw 17.

Figure 5:
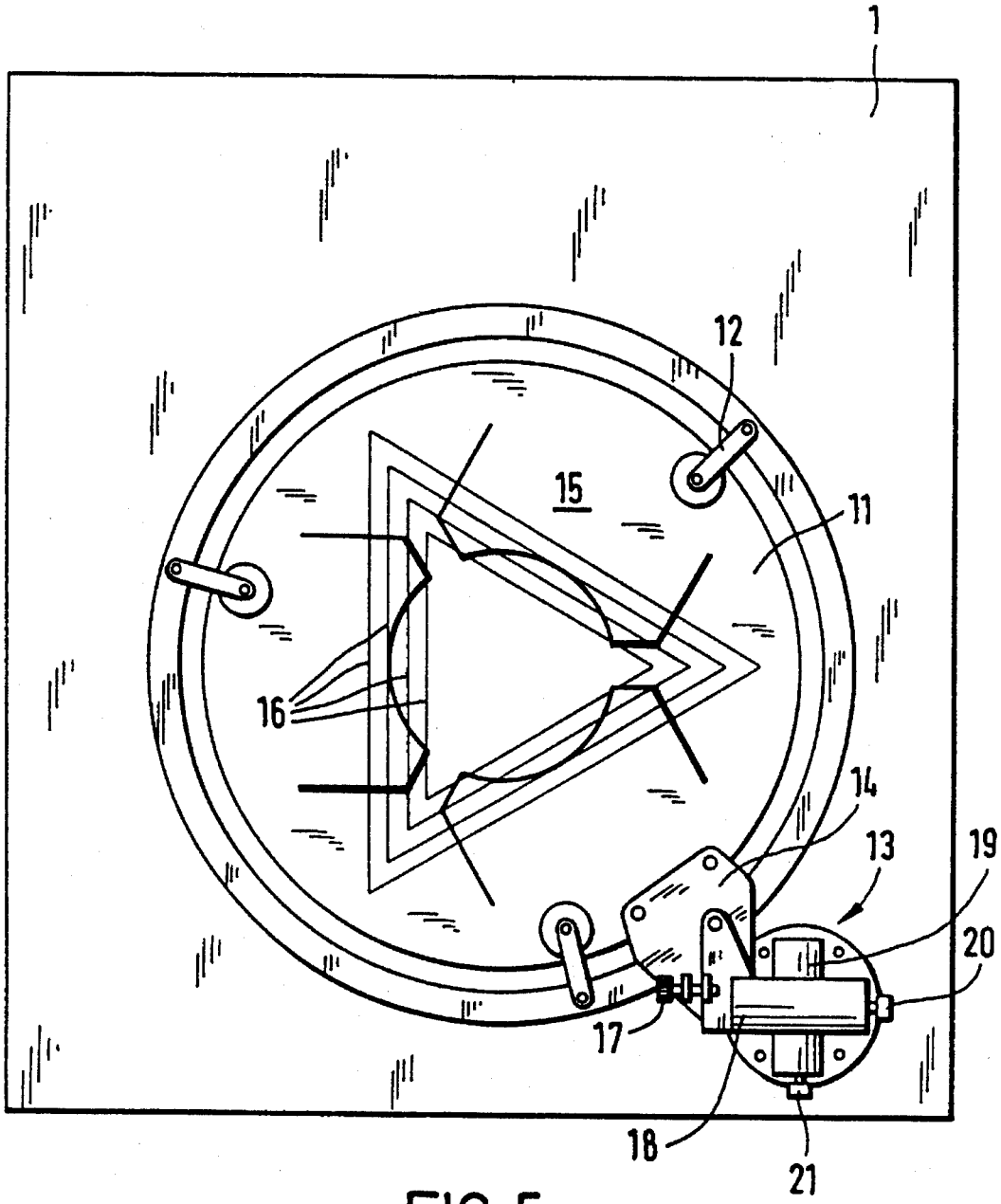
FIG. 5 is a view substantially corresponding to the view of FIG. 4 but having a different construction.

FIG. 5 shows in principle the same as FIG. 4, but here another guide 13 is provided. It is formed from a transverse slot 18 and a longitudinal slot 19 and can be adjustable by means of adjusting screws 20 and 21, so that the bar template 11 is adjustable relative to the ground disc 10 and its shadow image 15. For fine adjustment in the rotary direction an adjusting screw 17 is provided.

Figure 6:
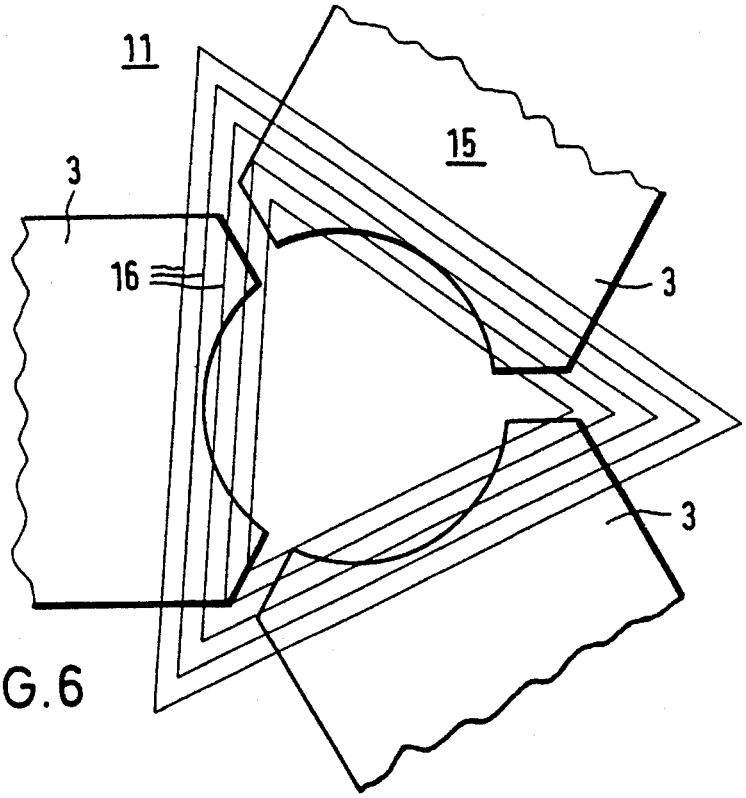
FIG. 6 is a view showing a template image at the beginning of the adjustment.

FIG. 6 shows on an increased scale the ground disc 10 together with the placed bar template 11. The rollers 3 are here partially shown as a shadow image 15 and are correctly adjusted in axial and radial directions. Also, the bar template 11 is located arbitrarily on the ground disc 10, as can be recognized from the triangle side 16 displaceable and turnable relative to the rollers 3. In the shown example the rollers 3 are uniformly distributed over the periphery or in other words, they are arranged at an angle 120° relative to one another. This is usually the case. However, other angular spacing is possible as well. In this case a different bar template than the bar template 11 is needed. In FIG. 6 the triangle sides 16 have, as the roller 3, an angular position of 120° relative to one another and form thereby a unilateral triangle. For the case when the caliber opening 7 is formed for example of five rollers, another angular position of the rotary axis is obtained than the triangle sides 16, and in particular octagon sides. The same is true for other numbers of rollers per caliber.

Figure 7:
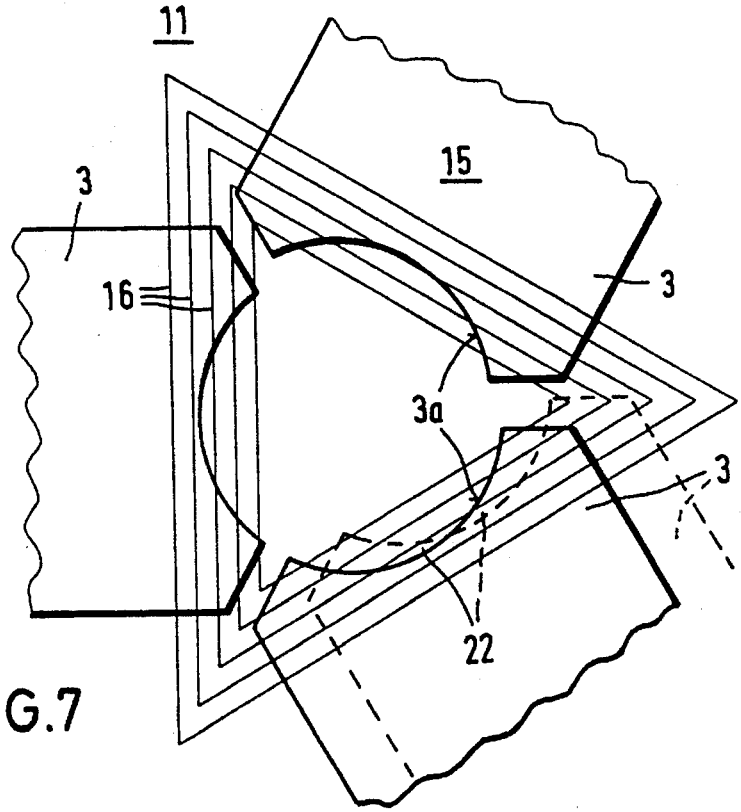
FIG. 7 is a view showing a template image after the orientation of the template in the turning direction.

Turning from the arbitrary situations of FIG. 6 the adjusting process of the rollers which are offset relative to one another 120° starts in that, the triangle sides 16 are turned and displaced first after calibration so relative to the shadow image 15 of the ground disc 10, that the triangle side 16 extends substantially parallel to the rotary axis of the rollers 3 and the joint inscribed circle center point of the triangle is located substantially in the center of the caliber opening. Remaining inaccuracies can be therefore observed. In this position the bar template 11 is clamped in the template holder 14. As long as this is provided, one of the rollers 3 is displaced in an axial direction as shown in FIG. 7 for the right lower roller 3 in solid and broken lines. If the triangle side 16 extends exactly parallel to the rotary axis of the rollers 3, a sickle gap 22 remains between the shadow image 15 of the working surface **3*a* of the axially adjusted roller 3 and one of the triangle sides 16 always at the same size, regardless of the axial position of the roller 3. If the sickle gap 22 changes which occurs in many cases, then with the help of the adjusting screw 17 the bar template 11 is turned so long til the sickle gap 22 during the axial displacement of the roller 3 remains the same. It does not matter what associated triangle side 16 is utilized for this. Preferably such a side is selected with which the sickle gap is as small as possible, but easily recognized since it can be evaluated the best. For this purpose the roller 3 or also the bar template 11** can be displaced in the radial direction.

When the position of a bar template is found in which the sickle gap 22 during the displacement of one of the rollers 3 remains the same, the adjusting screw 13 is arrested so that the bar template 11 can no longer be turned. FIG. 7 shows this situation. However, it can be clearly seen that the rollers 3 still do not assume their proper positions.

Figure 8:
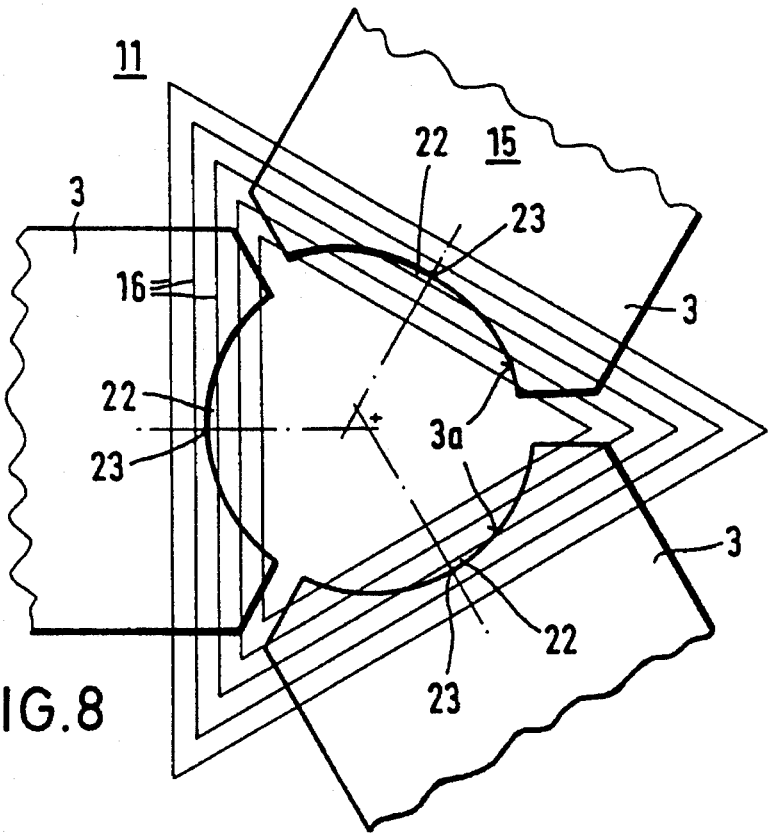
FIG. 8 is a template image after the orientation of the template also in the radial direction.

Next, a parallel displacement of the bar template 11 by means of the parallelogram guide 13 is performed until the sides 16 of one of the triangles which in FIG. 8 is the center triangle, either are brought in coincidence with the deepest points 23 of all working surfaces 3*a* or as shown in FIG. 8 at a uniform radial distance from the deepest points 23. The deepest point 23 is a point of the concavely shaped working surface 3*a* of a roller 3, which is located the closest to its rotary axis. The sickle gap 22 must be of the same size for all rollers 3. The bar template 11 is displaced parallel so long until this can be achieved, which, however, poses no problems. In the position shown in FIG. 8, the bar template 11 is completely arrested on the ground disc 10 by the holder 12 and can no longer be displaced.

Figure 9:
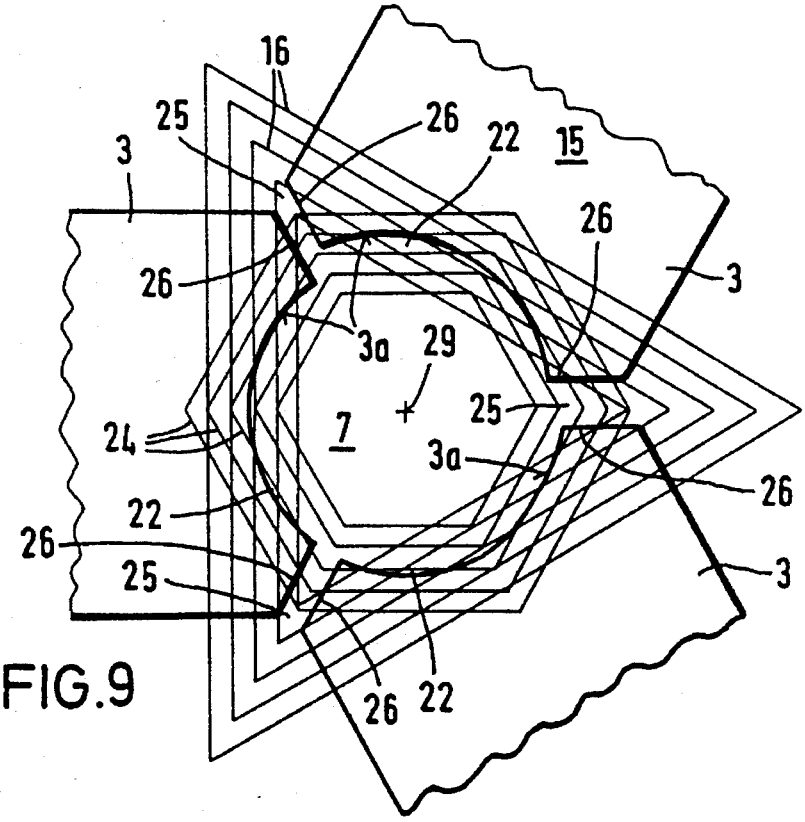
FIG. 9 is a view showing a template image with roof-shaped orientation lines.

After the bar template 11 is oriented in this manner relative to the shadow image 15 of the ground disc 10 and arrested, the adjustment of the rollers 3 is performed. This method step starts with an incorrect axial position of the rollers 3 as shown in FIGS. 6–9. FIG. 9 differs from FIG. 8 in that the additional concentric hexagons composed of orientation lines 24 are shown. Their inscribed circle center points not only lie on one another, but also on the inscribed circle center points of the triangles composed from the triangle sides 16. These center points 29 of the inscribed circles located on one another also show the caliber center. All orientation lines 24 have such an angular position that each second corner lies on the central perpendicular line to the triangle side 16 and the intermediately located hexagon corners on the same radial line as the triangle corners. Preferably, the orientation lines 24 are marked similarly to the triangle sides 16 on the same bar template 11. They must be shown in FIGS. 4–8 but are omitted there to clearly illustrate the process of the orientation of the bar template 11 relative to the shadow image 15 on the ground disc 10. The orientation lines 24 are not required for this.

As can be seen from FIG. 9, the rollers 3 always assume an axial position as in FIGS. 6–8. This is obtained accidentally. This is especially clearly seen on the different widths of the roller gap 25 formed from inclined edge surfaces 26 of the rollers 3. In order to arrive at an axial adjustment of the roller 3 which is as accurate as possible, during the adjusting process the edge surfaces 26 are not used for the orientation since between them and the working surfaces 3*a* which forms the caliber opening 7 an offset can be available. As during the orientation of the bar template 11 relative to the shadow image 15 of the ground disc 10, also the radial adjustment of the rollers is performed exclusively in accordance with the contours of the working surfaces 3*a*. Here each roller 3 is displaced in the axial directions so that two identical sickle gaps 22 are produced between the shadow image 15 of each working surface 3*a* and two neighboring orientation lines 24 of the same hexagon. Since in FIG. 9 all rollers 3 assume a false axial position, only one or two non-uniform sickle gaps 22 can be recognized at each roller. For example, the upper roller 3 in FIG. 9 must be displaced inclinedly to the right and downwardly in an axial direction, for producing a second sickle gap 22 at the same hexagon. The lower roller is to be displaced axially to the right and upwardly while the left central roller is to be displaced for the same reason upwardly.

Figure 10:
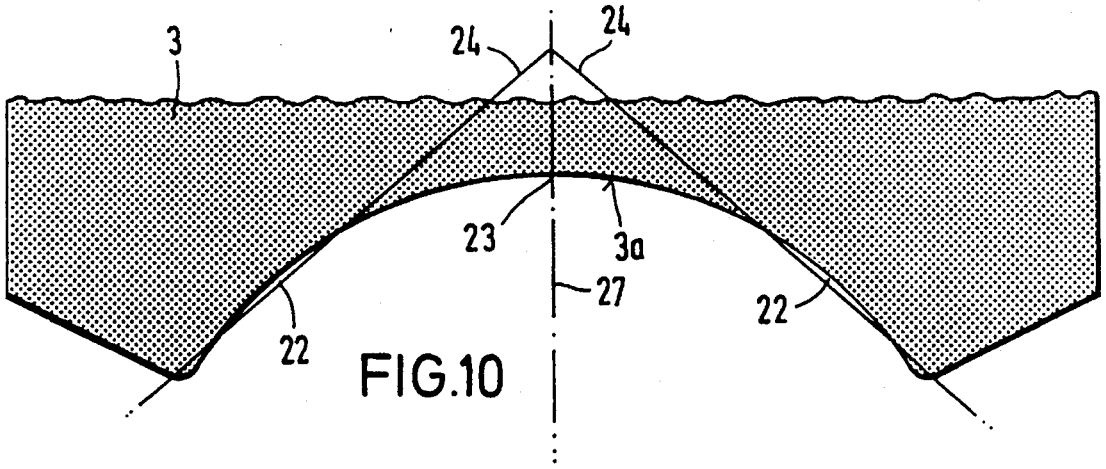
FIG. 10 is a view showing a shadow image of a roller with roof-shaped orientation lines.

In order to more clearly show the desired objective of an exact axial adjustment of the rollers 3, the shadow image 15 in FIG. 10 shows only one roller 3 on an increased scale together with two neighboring orientation lines 24 of the same hexagon. FIG. 10 shows the shadow image 15 of the rollers 3 after it has been exactly adjusted in an axial direction. Two sickle gaps 22 of identical sizes located symmetrically at both sides of a section plane 27 are clearly recognized. The section plane 27 extends through the deepest point 23 of the contour of the working surface 3*a* and perpendicularly to the rotary axis of the roller 3. Moreover the sickle gaps 22 have identical sizes and are arranged at both sides of the section plane 22 at a same distance therefrom. This can be better evaluated when the sickle gaps 22 are small. Each axial displacement of the roller 3 is characterized by substantial difference in the sickle gap 22 and can be corrected very accurately. The greater number of parallel orientation lines 24 or hexagons formed from them serves this purpose. With several hexagons there is a possibility to select always the hexagon and the orientation line 24 with which the smallest and best recognizable sickle gaps 22 are produced. In some cases also the roller 3 can be displaced in the radial direction, in order to bring the shadow image 15 of the roller 3 at a favorable radial distance in which the suitable sickle gaps 22 for the axial roller adjustment are produced.

Figure 11:
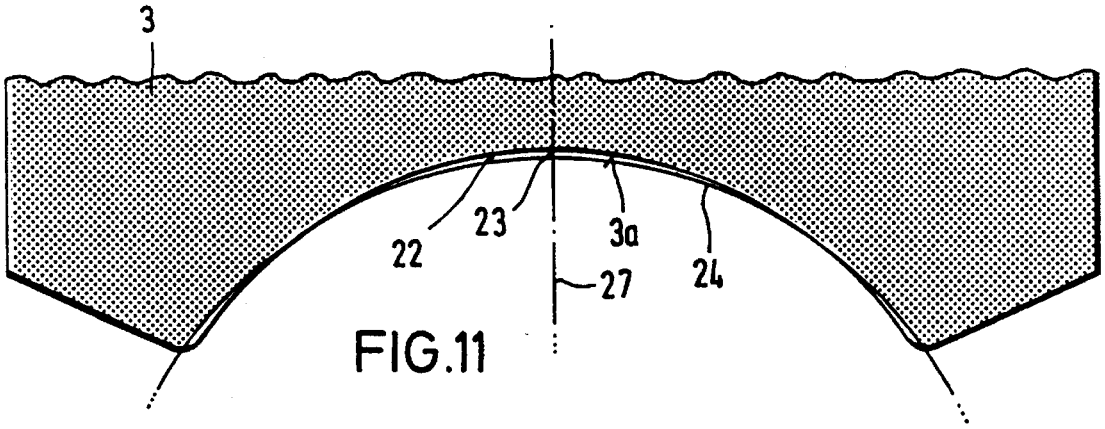
FIG. 11 is a view showing a shadow image of a roller with greater circular arc than the orientation line.
Figure 12:
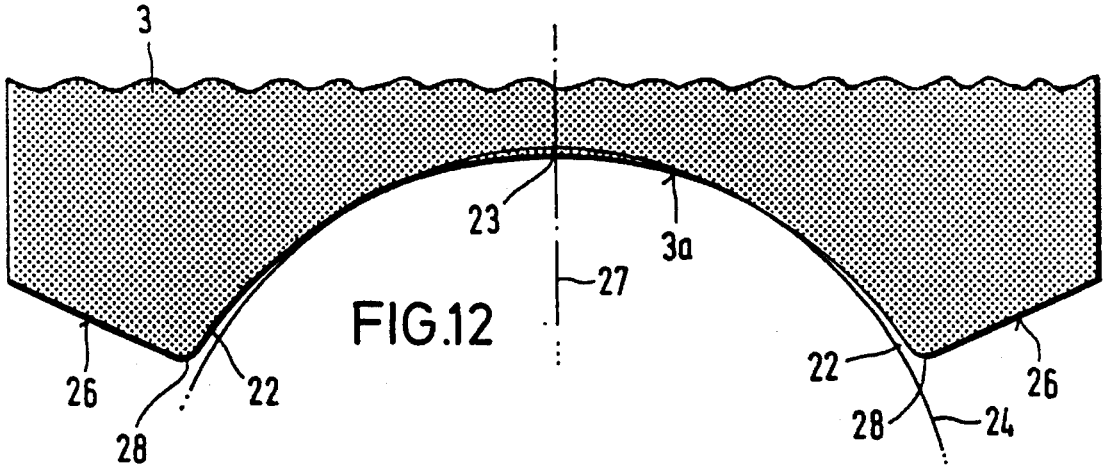
FIG. 12 is a view showing a shadow image of a roller with smaller circular arc than the orientation line.

FIG. 11 and 12 show that the orientation lines 24 are not necessarily part of a polygon and thereby must form a roof-shape as in FIGS. 9 and 10. Instead the orientation line 24 can be formed as circular arcs with a center point lying on the section plane 22 and instead of the hexagon shown in FIG. 9 are marked on the bar template 11. It is especially advantageous and preferable when the diameter of the circular arcs is selected not to be equal to the diameter of the caliber opening 7 on the shadow image 15. Only in this case such sickle gaps 22 are possible which provide an unobjectionable axial adjustment of the roller 3. A circular arc having a greater diameter is selected in FIG. 11 as the orientation line 24, and thereby only one single sickle gap 22 is produced. An exact adjustment of the roller 3 is provided when the sickle gaps 23 at both sides of the section plane 27 for the deepest point 23 have the same length. An insignificant axial displacement of the rollers 3 changes at both sides the length of the sickle gap 22 in an opposite direction, as can be clearly recognized when it is small as in FIG. 11. Thus, the roller 3 can be exactly adjusted in the axial direction. In the embodiment of FIG. 12 the orientation line 24 is a circular arc with a smaller diameter than the diameter of the caliber opening 7 of the shadow image 15. Here again the sickle gaps 22 are formed at the left and at the right near the inclined edge surfaces 26 and the transition 28 between the working surfaces 3*a* and the orientation line 24. The roller 3 is exactly adjusted when the sickle gaps 22 at both sides have the same lengths.

Figure 13:
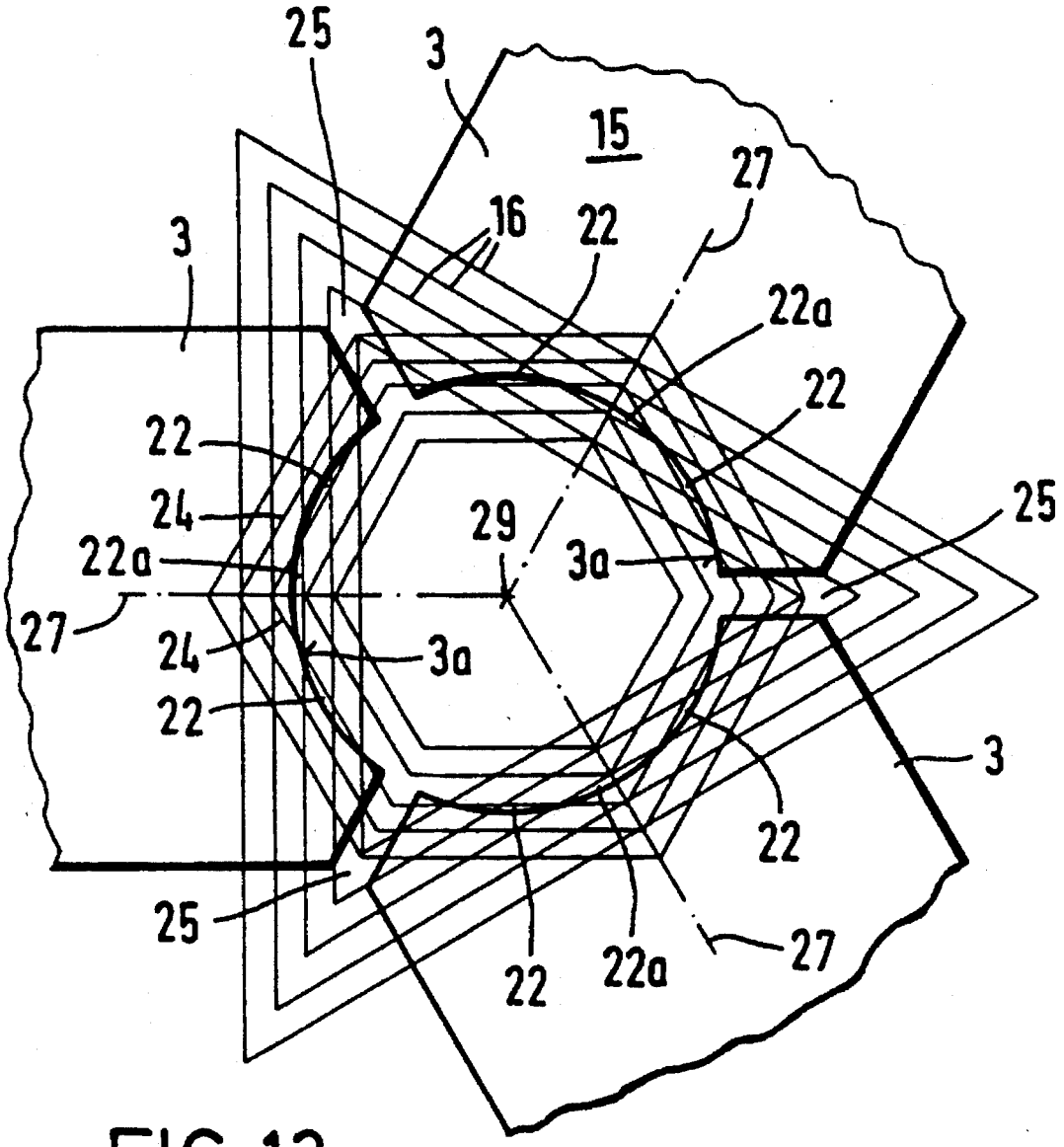
FIG. 13 is a view showing a template image after axial and radial adjustment of the rollers.

When all rollers 3 are adjusted in the axial direction correctly in the above described manner, for example in accordance with the roof-shaped orientation line 24, then an image shown in FIG. 13 is produced with two identical sickle gaps 22 at both sides of the section plane 27. The section plane 27 can be also marked on the bar template 11 for facilitation of the adjustment, as the inscribed circle center point of the caliber center 29. This marking is not necessarily required, however, it facilitates the adjustment.

In general, the rollers 3 are located after the actual adjustment also in the radial direction in their correct positions as shown in FIG. 13, especially when the radial displacement of all rollers 3 inside the rolling stand 2 is performed jointly and a corresponding device is provided. For post-adjusting of this device and also for the case when the rollers 3 are individually adjusted in the radial direction, after the axial adjustment of the rollers 3 also a radial adjustment can be performed. Also, for this purpose either the orientation line 24 or the triangle side 16 are used, which are located concentrically to the caliber center 29. The sickle gaps 22 play here also the decisive role in the same manner on the working surface 3*a*. After the radial adjustment of the rollers, they must be of identical sizes for all three rollers. Here it does not matter whether the three sickle gaps 22*a* are compared with one another in the region of the section planes 27 of each roller 3, or for this purpose six sickle gaps 22 at the left and at the right of the cutting planes 27 are utilized.

FIG. 14 shows a measuring device 30 which is formed similarly to the adjusting device 1. However, there is no light source 5, the mirror 8, the optical system 9 as well as the ground disc 10 and the bar template 11. Instead, the holder 4 carries a measuring probe 31 which is displaceable in all directions. The measuring probe 31 includes a measuring pin 32 provided with a measuring ball 33. All displacement movements of the measuring ball 33 are evaluated by a not shown computer. Such measuring devices with the computer are known and used for different measuring purposes.

Figure 16:
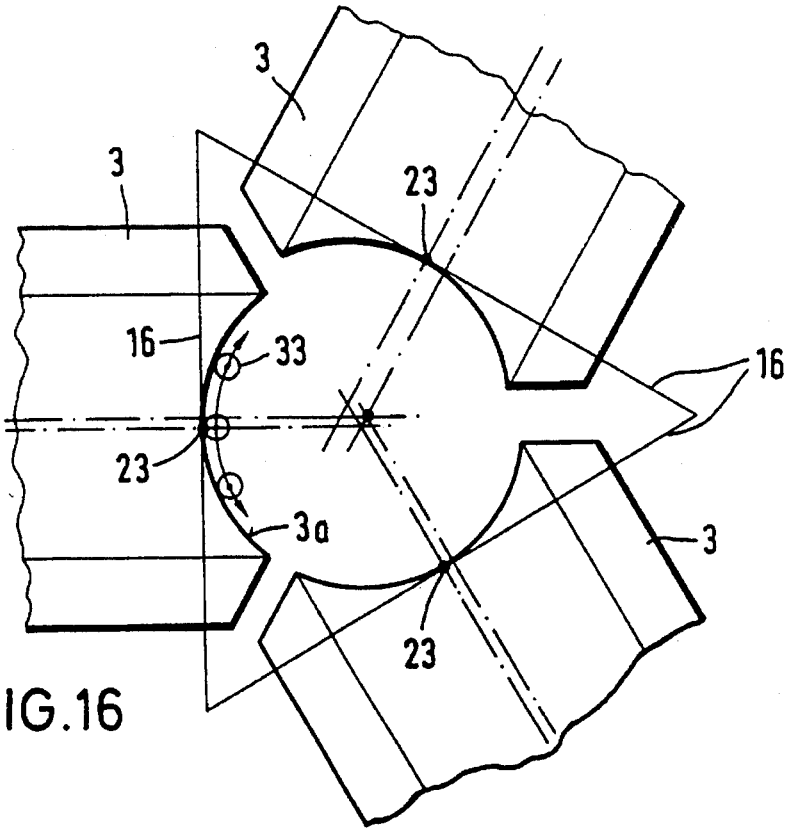
FIG. 16 is a view illustrating a search of the deepest point per measuring device.

FIG. 15 shows how the measuring probe 31 with the measuring pin 32 is introduced into the caliber opening 7 of the rolling stand 2. First it is guided exactly perpendicularly along the working surface 3*a* of the roller 3 in order to determine the position of the rotary axis plane 6 which is located where the measuring ball 33 is deviated at most in the radial direction. Then adjusted to this rotary axis plane, the deepest point 23 of the working surface 3*a* of the same roller 3 is first to be determined. This is shown in FIG. 16. The measuring ball 33 is moved in the rotary axis plane 6 along the contour of the working surface 3*a*. The deepest point 23 is located where the measuring ball 33 is deviated the most in the radial direction, or in other words at the smallest distance from the rotary axis. During sensing the contour of the working surface 3*a*, also the remaining measuring values are supplied to the computer so that it recognizes not only the deepest point 23 but also the shape and position of the working surface contour. From these measuring values the computer, due to the stored computer program, can compute the parallel to the rotary axis which extends through the deepest point 23. Thereby the triangle side 16 becomes known to the computer. The same procedure can be repeated for the other rollers. Since the angular position of the rollers 3 relative to one another is known and stored in the computer, which is for example 120°, the computer also computes the triangle shown in FIG. 16 composed of the remaining triangle sides 16. Normally, the radial adjustment of the rollers 3 and their diameters are identical, as can be seen in FIG. 16. In this case the remaining deepest points 23 of both other rollers 3 are located also on the triangle side 16. However, as can be clearly recognized, they are displaced in axial direction since the rollers 3 assume a false position in the axial direction.

Figure 17:
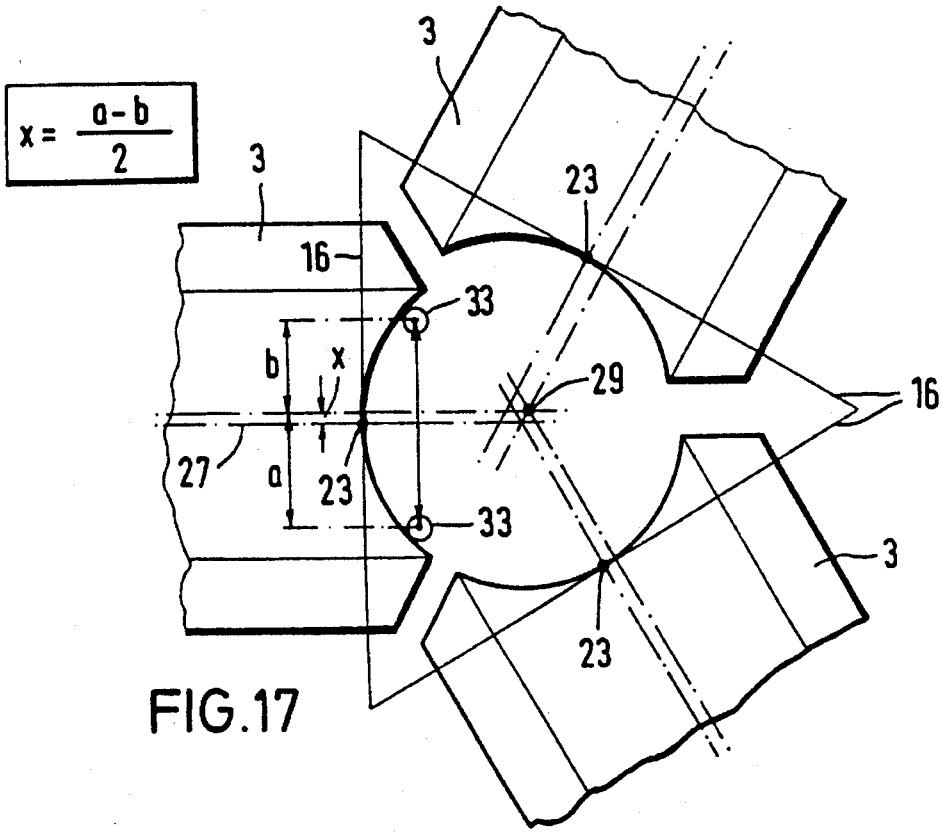
FIG. 17 is a view showing a search of the axial roller offset per measuring device.

FIG. 17 shows how by means of the measuring device 30 the roller offset can be adjusted for each roller, so as to displace the respective roller 3 in the axial direction. As described in connection with FIG. 16, the computer computes the triangle formed from the triangle side 16 and computes then also the angle bisectors and the position of their intersection points, or in other words the inscribed circle center point and the caliber center 29. For adjusting the rollers 3, the measuring ball 33 is moved parallel to the rotary axis or the associated triangle side 16, and in this manner the non-uniform distances a and b are measured, which corresponds to the contact points of the measuring ball 33. From the difference of the both distances a and b divided by two, the value x is produced by which the respective roller 3 must be displaced in the axial direction for obtaining its correct position. This is the position in which the roller center which is identified above as the section plane 27 and extends through the deepest point 23 as well as perpendicularly to the rotary axis, also intersects the caliber center 29 and thereby the inscribed circle center point of the triangle. The same is performed for all rollers 3 of the caliber. Subsequently, again the position of the deepest points 23 can be determined as described in connection with FIG. 16. These deepest points 23 must then have the same desired radial distance from the inscribed circle center point or the caliber center 29, which is determined by the diameter of the rolling stand. If this must not be so, the respective roller 3 is post-adjusted also in the radial direction until this condition is fulfilled.

It will be understood that each of the elements described above, or two or more together, may also find a useful application in other types of constructions differing from the types described above.

While the invention has been illustrated and described as embodied in a method of and arrangement for adjusting three caliber opening-forming rollers or guiding rollers, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. An arrangement for adjusting of three caliber opening-forming rolling elements, comprising a light source located on one axial side of the rolling element; a device located at another axial side of the rolling element that receives a shadow image of a caliber contour and having a turnable, displaceable and arrestable bar template, said bar template being marked with at least one polygon which corresponds to the number of rolling elements of a caliber and has sides which are offset from one another in an angular position corresponding to an angular position of rotary axes of rolling elements and center points of inscribed circles of several such polygons are located on one another.

* * * * *